United States Patent [19]

Cumpston

[11] Patent Number: 4,515,144

[45] Date of Patent: May 7, 1985

[54] HAND-FIRED, SOLID FUEL STOVE

[76] Inventor: Edward H. Cumpston, 6 Stonehedge Dr., Bennington, Vt. 05201

[21] Appl. No.: 544,570

[22] Filed: Oct. 24, 1983

[51] Int. Cl.[3] ..... F24C 1/00

[52] U.S. Cl. ..... 126/58; 126/65; 126/173; 126/197

[58] Field of Search ..... 126/58–77, 126/190, 194, 197, 173, 152 R, 123, 126, 176 A

[56] References Cited

U.S. PATENT DOCUMENTS

| | | | |
|---|---|---|---|
| 2,497,877 | 2/1950 | Fellows | 126/73 |
| 4,099,511 | 7/1978 | McIntire et al. | 126/190 |
| 4,102,318 | 7/1978 | Runquist | 126/76 |

FOREIGN PATENT DOCUMENTS

| | | | |
|---|---|---|---|
| 524754 | 9/1921 | France | 126/58 |
| 219702 | 9/1925 | United Kingdom | 126/58 |
| 452467 | 8/1936 | United Kingdom | 126/73 |
| 108291 | 8/1939 | United Kingdom | 126/73 |

*Primary Examiner*—James C. Yeung

*Attorney, Agent, or Firm*—Stonebraker, Shepard & Stephens

[57] ABSTRACT

An inclined and perforated grate 20 is arranged in a hand-fired, solid fuel stove 10 having a fuel door 11, an ash pit 18 under grate 20, and a combustion air inlet opening 24 to a region under grate 20. Grate 20 inclines to slope downward with increasing distance from fuel door 11, the upper surface of grate 20 is generally flat, and it is arranged to stay fixed in place during use. The central region of grate 20 has a plurality of perforations 22 through which combustion air can rise and ashes can fall. Fuel door 11 is arranged to provide access to grate 20 so that a hand-held poker 40 can be scuffed up and down the inclined upper surface of grate 20 to dislodge ashes that fall through perforations 22 into ash pit 18.

15 Claims, 3 Drawing Figures

HAND-FIRED, SOLID FUEL STOVE

BACKGROUND

This invention arose from dissatisfaction with hand-fired heating stoves capable of burning coal, wood, and other solid fuels. Coal fires require a grate elevated over an ash pit and some way of occasionally separating the ashes from the burning coals or else the ashes will smother the fire. For this reason, coal grates have used movable fingers that can be shaken to dislodge ashes that fall through the grate. Shaker grate elements occasionally jam and become immovable, however. This makes the fire go out and requires manually dislodging the obstruction after the grate has cooled.

In solving the problems of a movable element coal grate, I have devised several improvements for a hand-fired, solid fuel stove. By a new combination of features, my stove makes it easy and convenient to dislodge ashes from the fuel bed. It is also easy to fuel the fire and remove the ashes that fall through the grate. My stove evenly distributes combustion air throughout a large central region of the fuel bed, and it tends to keep fuel logs juxtaposed and burning, even as they reduce in size. My stove accomplishes these advantages and more with a simple, rugged, and economical construction affording an efficient, convenient, and trouble-free stove.

SUMMARY OF THE INVENTION

My heating stove can be hand fired with coal, wood, and other solid fuels; and it includes a fuel door, a grate, an ash pit, and a combusion air inlet to a region under the grate. The grate is inclined to slope downward with increasing distance from the fuel door. The upper surface of the inclined grate is generally flat, and the grate is arranged to stay fixed in place during use. A central region of the grate has a plurality of perforations through which combustion air can rise and ashes can fall. The fuel door is arranged to provide access to the grate so that a hand-held poker can be scuffed up and down the inclined upper surface of the grate to dislodge ashes that fall through the perforations into the ash pit.

DRAWINGS

DETAILED DESCRIPTION

Figure 1:
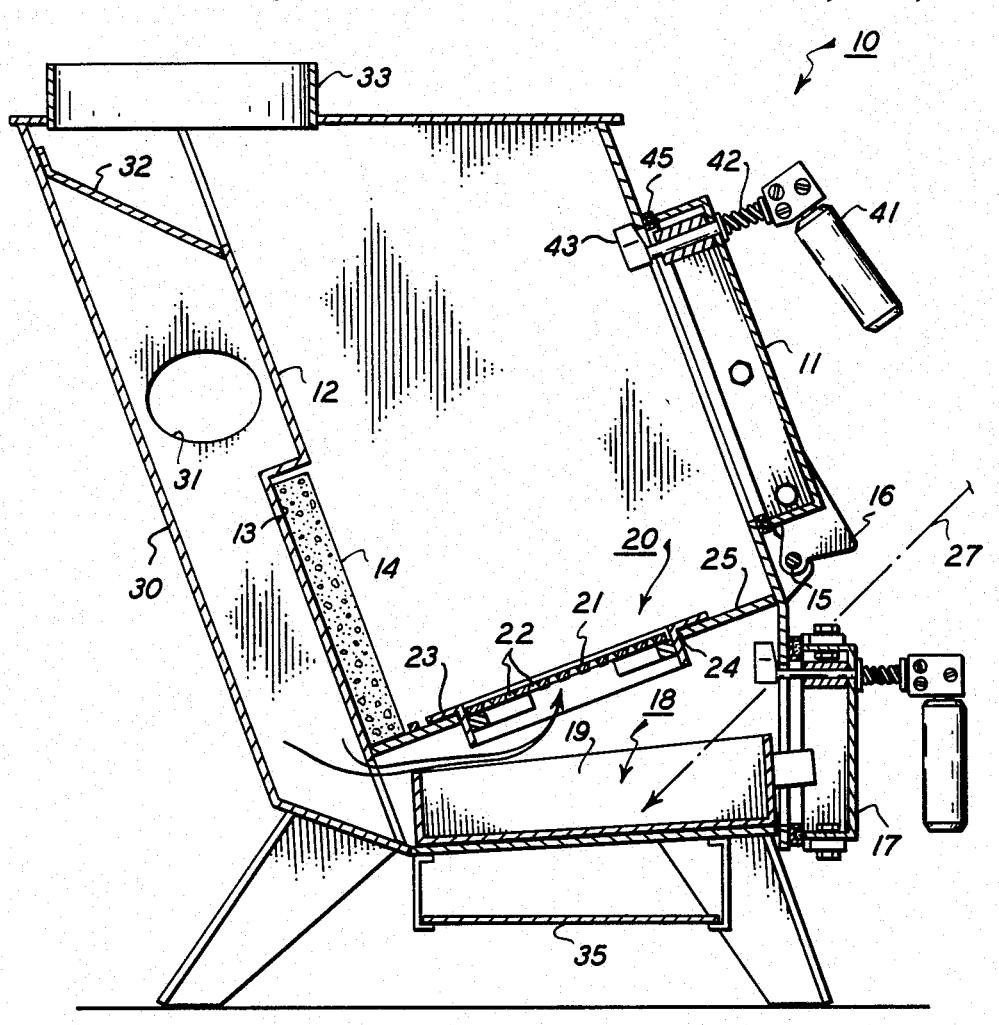
FIG. 1 is a cross-sectional view of a preferred embodiment of my stove.

Many features of my stove 10 involve its grate 20, which is tilted from horizontal, by about 15° to 25° and preferably by about 20°, as shown in the drawings of my preferred embodiment. The inclination of grate 20 is preferably accompanied by tilting the portion of stove 10 above grate 20. Such an arrangement benefits fueling, fire maintenance, combustion air inflow, ash removal, construction expense, compactness, safety, and general convenience. A full explanation of these advantages follows a description of the preferred stove structure.

Grate 20 includes a perforated flat plate 21 held within a frame 23 that fits removably into a central opening 24 of an otherwise unperforated plate 25 that supports the fuel bed. Different frames or holders can support plate 21 so it can be replaced if necessary. The components of grate 20 form a generally flat upper surface so as not to obstruct movement of a poker as explained below. Perforations 22, preferably circular holes from $\frac{1}{2}$ to $\frac{3}{4}$ inches in diameter, closely arrayed over plate 21, allow combustion air to rise and ashes to fall through grate 20. The size, shape, and spacing of perforations 22 can vary.

Tilting the upper portion of stove 10 above grate 20 inclines fuel door 11 and stove wall 12 opposite fuel door 11 so that these are both approximately perpendicular to grate 20. Wall 12 is preferably formed with an offset or recess 13 shaped to receive fire bricks 14 that can rest in place without any attachment.

Figure 2:
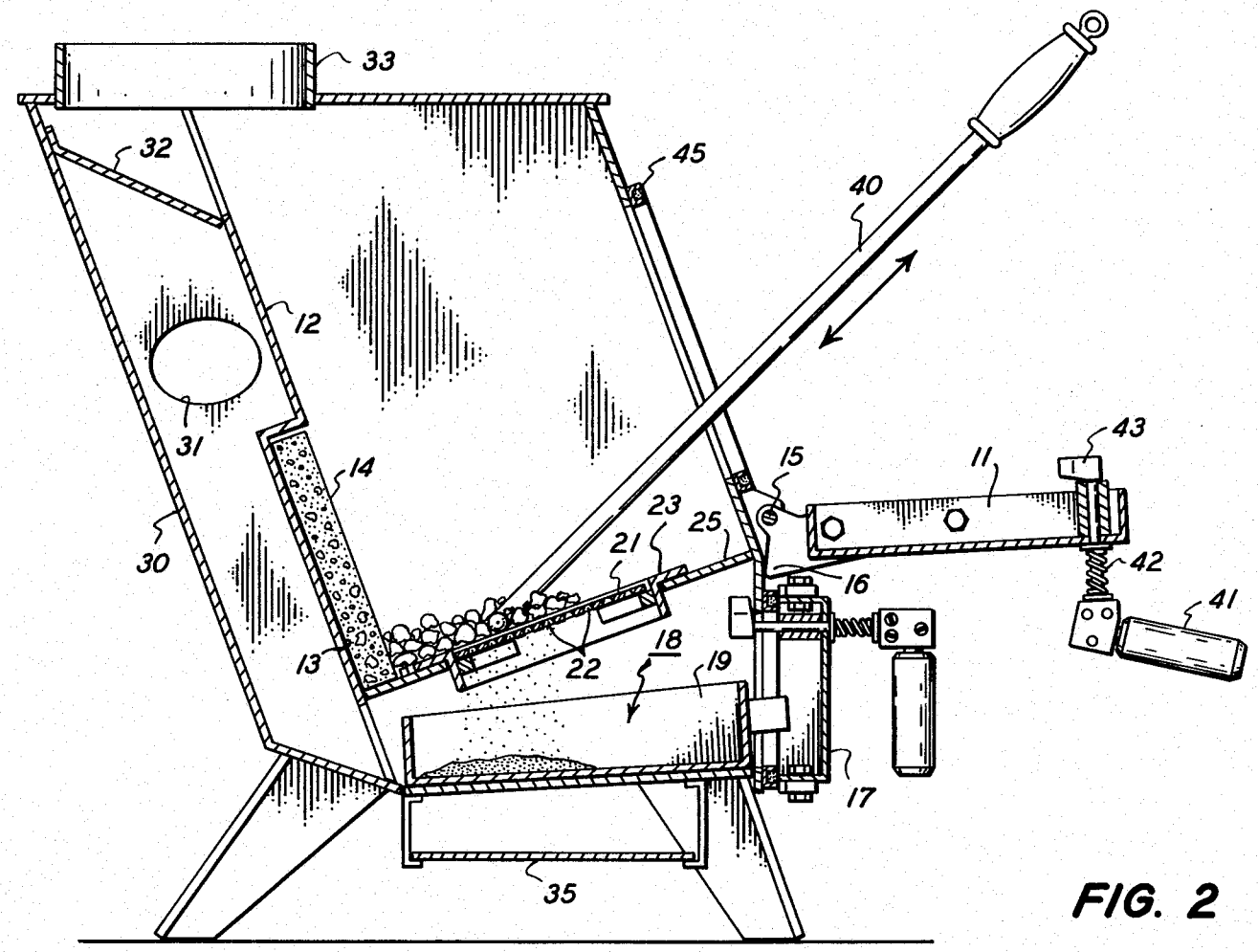
FIG. 2 is a cross-sectional view similar to the view of FIG. 1 showing how the fuel door opens and how my stove allows ashes to be dislodged from a fuel bed with a hand-held poker.

Fuel door 11 preferably has a bottom hinge 15 and a stop 16 arranged so that door 11 opens from the top down and stops in a horizontal position as shown in FIG. 2. Handle 41 for fuel door 11 preferably rotates around shaft 42 that carries a latch dog 43 on its inner end. Spring 44 surrounding shaft 42 biases door 11 closed with uniform force, even as a door seal (not shown) in channel 45 becomes compressed from use.

Ash door 17 below fuel door 11 and the upper edge of inclined grate 20 provides access to ash pit 18 under grate 20. An ash pan or drawer 19 disposed in ash pit 18 collects ashes falling through perforations 22 in plate 21. A sheet metal plate 35 suspended under ash pit 18 serves as a heat shield protecting the floor or hearth under stove 10.

A channel 30 adjacent stove wall 12 has an air inlet opening 31 and provides a passageway communicating with ash pit 18 under grate 20 to admit combustion air to the region under grate 20 so it can rise through perforations 22 in plate 21. Air from outside the stove is preferably metered through opening 31 by an air inlet controller as suggested in my copending U.S. patent application Ser. No. 377,710, filed May 13, 1982, U.S. Pat. No. 4,457,294 entitled INLET AIR CONTROL FOR STOVE OR FURNACE. A plate 32 secured over the top of channel 30 provides cleanout access and is disposed under adapter 33, which receives a stove pipe.

The sloping and perforating of grate 20 cooperates with other stove elements to yield several advantages. These combine to improve convenience, efficiency, and safety.

Fuel enters stove 10 through fuel door 11 on the high side of inclined grate 20 so that the fuel falls downward away from fuel door 11 and onto the burning fuel bed, which tends to settle toward the lower side of grate 20. This helps burning logs stay nestled together as they burn down so they keep burning without manual intervention. The inclination of fuel door 11 and grate 20 also ensures that burning logs will not roll against door 11 and spill out of stove 10 when door 11 is opened, as can happen with vertical fuel doors.

Figure 3:
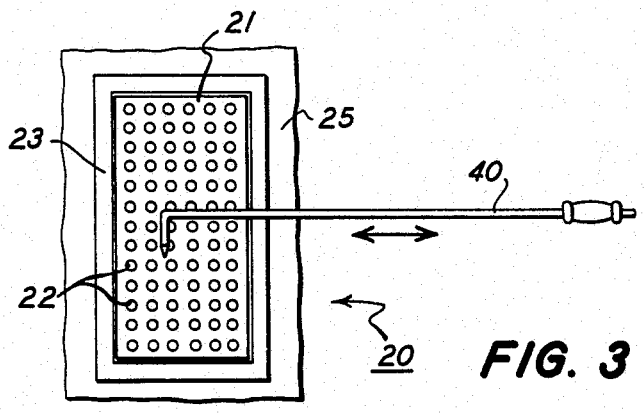
FIG. 3 is a plan view of the preferred grate for the stove of FIGS. 1 and 2 showing how poker motion can dislodge ashes.

The fuel door opening adjacent the upper edge of inclined grate 20 makes ash dislodgment with a hand-held poker 40 easy and convenient as shown in FIGS. 2 and 3. Merely moving poker 40 up and down the conveniently inclined surface of grate 20 under a coal fire moves the burning coals sufficiently to dislodge their ashes, which fall through perforations 22 in plate 21. A few in-and-out thrusting strokes with poker 40 noticeably settles a burning coal bed and indicates ash separation. This is not only quick and easy, but also avoids the problems of movable grate elements. Ashes from wood fires generally fall through perforations 22 without assistance, but these also can be raked through perforations 22 with a poker 40 if desired.

Inclining grate 20 also facilitates ash removal. A commodious ash pan 19 can fit within wedge-shaped ash pit 18; and the space available under the upper region of grate 20 opens an inclined line-of-sight 27 as suggested by the broken lines in FIGS. 1 and 2, making it easier to see how full pan 19 has become. Ash door 17 can open a sufficient vertical opening for line-of-sight 27 and for easy removal of pan 19 without requiring the entire stove to be raised by such a vertical extent.

Movable grate elements generally extend for the full width of a stove, but fixed and perforated plate 21 is preferably confined to a central region of grate 20 around unperforated border 25. This makes combustion air rise uniformly through the central region of grate 20 and pass directly through the burning fuel bed where it will be most effective. It also keeps air from rising around the periphery of the grate where it can follow a path of less resistance, missing the fuel bed. Keeping combustion air flow in the central region of grate 20 also keeps the hottest part of the fire in the center of the stove and reduces thermal stress on stove walls.

Stopping the opening of fuel door 11 in a horizontal position with hinge 15 and stop 16 forms a natural barrier, keeping dogs and children away from stove 10 when fuel door 11 is open. Rotating handle 41 outward, as shown in FIG. 2, makes it visible and conveniently available for closing fuel door 11.

The features combined in my stove make it not only convenient and safe, but compact, efficient, and economical. Moreover, it achieves these advantages with a low cost construction that is durable and serviceable.

I claim:

1. A hand-fired, solid fuel stove having a fuel opening closed by a fuel door, a grate below and adjacent said fuel opening, an ash pit under said grate, and a combustion air inlet to a region under said grate, said stove comprising:

a. said grate being inclined to slope downward with increasing distance from said fuel opening;

b. an upper surface of said inclined grate being generally flat so that a poker can skid freely along said upper surface;

c. said grate being arranged to stay fixed in place during use;

d. a central region of said grate having a plurality of perforations through which combustion air can rise and ashes can fall;

e. an upper border of said grate in a region near said fuel opening being unperforated; and f. said perforated central region of said grate being sufficiently close to said fuel opening and said fuel opening having a lower edge spaced sufficiently close to said upper border of said grate so that a hand-held poker can be thrust through said fuel opening to engage said upper border of said grate at an acute angle a few degrees above the inclination of said grate wherein said poker can be skidded along said flat upper surface of said inclined grate to slide under a burning region of said fuel bed located over said perforated central region to dislodge ashes that fall through said perforations into said ash pit.

2. The stove of claim 1 wherein a wall of said stove rising from a lower region of said grate is approximately perpendicular to said grate.

3. The stove of claim 1 wherein said fuel opening is in a stove wall that is approximately perpendicular to said grate.

4. The stove of claim 3 wherein a wall of said stove rising from a lower region of said grate is approximately perpendicular to said grate.

5. The stove of claim 3 including a hinge and stop arranged in a lower region of said fuel door so that a top region of said fuel door opens downward and said fuel door stops at a position approximately horizontal.

6. The stove of claim 1 wherein said inclination of said grate is 15° to 25° from horizontal.

7. The stove of claim 6 wherein a wall of said stove rising from a lower region of said grate is approximately perpendicular to said grate, and said fuel opening is in a stove wall that is approximately perpendicular to said grate.

8. The stove of claim 1 including an ash door arranged below said fuel door and below an upper region of said grate and an ash pan removably disposed in said ash pit to collect ashes falling through said grate so that said inclination of said grate facilitates inspection of said ash pan and withdrawal of said ash pan through said ash door.

9. The stove of claim 1 wherein said grate has an unperforated border adjacent walls of said stove.

10. The stove of claim 9 wherein said central perforated region of said grate is arranged within a frame that is removable and replaceable.

11. The stove of claim 10 wherein said inclination of said grate is 15° to 25° from horizontal.

12. The stove of claim 11 wherein a wall of said stove rising from a lower region of said grate is approximately perpendicular to said grate.

13. The stove of claim 12 wherein said fuel opening is in a stove wall that is approximately perpendicular to said grate.

14. The stove of claim 13 including an ash door arranged below said fuel door and below an upper region of said grate and an ash pan removably disposed in said ash pit to collect ashes falling through said grate so that said inclination of said grate facilitating inspection of said ash pan and withdrawal of said ash pan through said ash door.

15. The stove of claim 14 including a hinge and stop arranged in a lower region of said fuel door so that a top region of said fuel door opens downward and said fuel door stops at a position approximately horizontal.

* * * * *